US010206477B2

(12) United States Patent
Lopez

(10) Patent No.: US 10,206,477 B2
(45) Date of Patent: Feb. 19, 2019

(54) POWDER-DISPENSING DEVICE FOR SANITARY GROOMING

(71) Applicant: Rosalyn Marie Lopez, Las Vegas, NV (US)

(72) Inventor: Rosalyn Marie Lopez, Las Vegas, NV (US)

( * ) Notice: Subject to any disclaimer, the term of this patent is extended or adjusted under 35 U.S.C. 154(b) by 165 days.

(21) Appl. No.: 14/843,064

(22) Filed: Sep. 2, 2015

(65) Prior Publication Data

US 2015/0374095 A1 Dec. 31, 2015

Related U.S. Application Data

(63) Continuation-in-part of application No. 13/541,666, filed on Jul. 4, 2012.

(51) Int. Cl.
*A45D 33/00* (2006.01)
*A45D 44/00* (2006.01)

(52) U.S. Cl.
CPC ..... *A45D 33/005* (2013.01); *A45D 44/00* (2013.01); *A45D 2200/1018* (2013.01)

(58) Field of Classification Search
CPC .... A45D 33/00; A45D 33/005; A45D 33/006; A45D 33/02; A45D 33/18; A45D 33/34; A45D 33/36; A63B 29/02
USPC ..... 206/315.1; 222/457.5
See application file for complete search history.

(56) References Cited

U.S. PATENT DOCUMENTS 1,330,372 A * 2/1920 Grossman ..... A45D 33/34 132/312
1,468,164 A * 9/1923 McCarty ..... A45D 33/34 401/200
1,801,898 A * 4/1931 Biondi ..... A45D 33/34 401/200
1,944,204 A * 1/1934 Wutzke ..... A45D 33/34 401/200
2,233,686 A * 3/1941 Topjian ..... A45D 33/34 401/200
2,932,839 A * 4/1960 Flanigan ..... A47L 13/17 15/209.1
4,917,134 A * 4/1990 Simonzi ..... A61M 35/00 132/320
6,902,338 B2 * 6/2005 Puvvada ..... A47K 7/03 401/201

(Continued)

FOREIGN PATENT DOCUMENTS

KR 10-2012-0025345 * 3/2012

*Primary Examiner* — Tatiana Nobrega
*Assistant Examiner* — Brianne Kalach
(74) *Attorney, Agent, or Firm* — Etherton Law Group, LLC

(57) ABSTRACT

A grooming device that absorbs moisture or oil on a patron and applies a light layer of powder to the patron, thus enabling unwanted hair to be easily brushed off the patron. The device employs a powder-dispensing head made of mesh or woven material that permits powder to pass from the head through the holes in the mesh or weave. The head is connected to or integral with a holder that enables a user's hand to stay powder-free while using the device by preventing powder from escaping onto the hand of the user holding the holder. A retainer positioned at the intersection of the head and a holder creates the cavity in the head that holds the powder. Optionally, a head ribbon is attached to or integral with at least a portion of the head and is detachably connected to the holder of a second grooming device.

1 Claim, 9 Drawing Sheets

(56) References Cited

U.S. PATENT DOCUMENTS

| | | | | |
|---|---|---|---|---|
| 2006/0207046 | A1* | 9/2006 | Manlove | A45D 33/34<br>15/227 |
| 2008/0164288 | A1* | 7/2008 | Singleton | A01C 7/02<br>222/465.1 |

* cited by examiner

POWDER-DISPENSING DEVICE FOR SANITARY GROOMING

CROSS-REFERENCE TO RELATED APPLICATIONS

This application claims the benefit of co-pending U.S. application Ser. No. 13/541,666 filed Jul. 4, 2012 which is incorporated by reference.

FIELD OF INVENTION

This invention relates generally grooming devices. This invention relates particularly to a sanitary powder-dispensing grooming device used in hair styling.

BACKGROUND

After a patron's hair is cut, it is desirable to remove the cut-away hair. Unfortunately the cut-away hair pieces tend to stick to moist or oily skin, making it difficult to remove. Traditionally a hairstylist or barber uses a plastic or wood brush with long bristles to brush away the hair. Some such brushes have pockets in them for holding talcum powder, known in the industry as talc brushes. Unfortunately, the present grooming devices are difficult to clean and sanitize, which creates an unsafe environment for the patrons and makes it difficult to comply with state boards' of cosmetology rules on sanitation.

For example the Nevada Administrative Code §§ 644.335 6 & 7 requires that "[A]ll instruments and supplies, including, without limitation, neck strips, nail files and buffers, that come into direct contact with a client and cannot subsequently be disinfected must be disposed of in a waste receptacle immediately following their use" and that "[n]eck dusters and all other brushes used on a client must be maintained in a clean and sanitary condition." Thus, a talc brush cannot be used on another patron without sterilizing it first. Unfortunately, talc brushes are difficult to sanitize, which means that a stylist either has to have a new talc brush for each patron or has to have several sanitized talc brushes in inventory as patrons arrive more quickly than the brushes can be cleaned. It's expensive to keep multiple existing talc brushes and difficult to clean them without damaging them. It would be desirable to have a cost-effective grooming device that is sanitary for removing cut-away hair on a patron.

Therefore, it is an object of this invention to provide a grooming device that is sanitary each time it is used. It is another object to provide a grooming device that complies with the State Boards' of Cosmetology laws and sanitations requirements. Another object is to provide a grooming device that absorbs liquids, moisture, and hair and body oils. A further object is to provide a grooming device that evenly and comfortably smoothes a patron's skin in preparation for hair removal. Yet another object is to provide such a grooming device that removes unwanted cut hair from a patron.

SUMMARY OF THE INVENTION

This invention is a grooming device that absorbs moisture or oil on a patron and applies a light layer of powder to the patron, thus enabling unwanted cut-away hair to be more easily brushed off the patron. The device employs a powder-dispensing head made of mesh or woven material that permits powder to pass from inside the head to outside the head through the holes in the mesh or weave. The head is connected to or integral with a holder that limits the amount of powder that gets on a user's hand while using the device by preventing powder from escaping onto the user's hand. A retainer positioned at the intersection of the head and a holder creates the cavity in the head that holds the powder. Optionally, a head ribbon is attached to or integral with at least a portion of the head and is detachably connected to the holder of a second grooming device to aid in dispensing the device from a dispenser. The device may be made of sanitizable materials and re-used, such as cotton. Alternatively the device may be a single-use device made of materials that may not be sanitizable but are disposable, such as air-laid paper.

DETAILED DESCRIPTION OF THE INVENTION

Figure 1A:
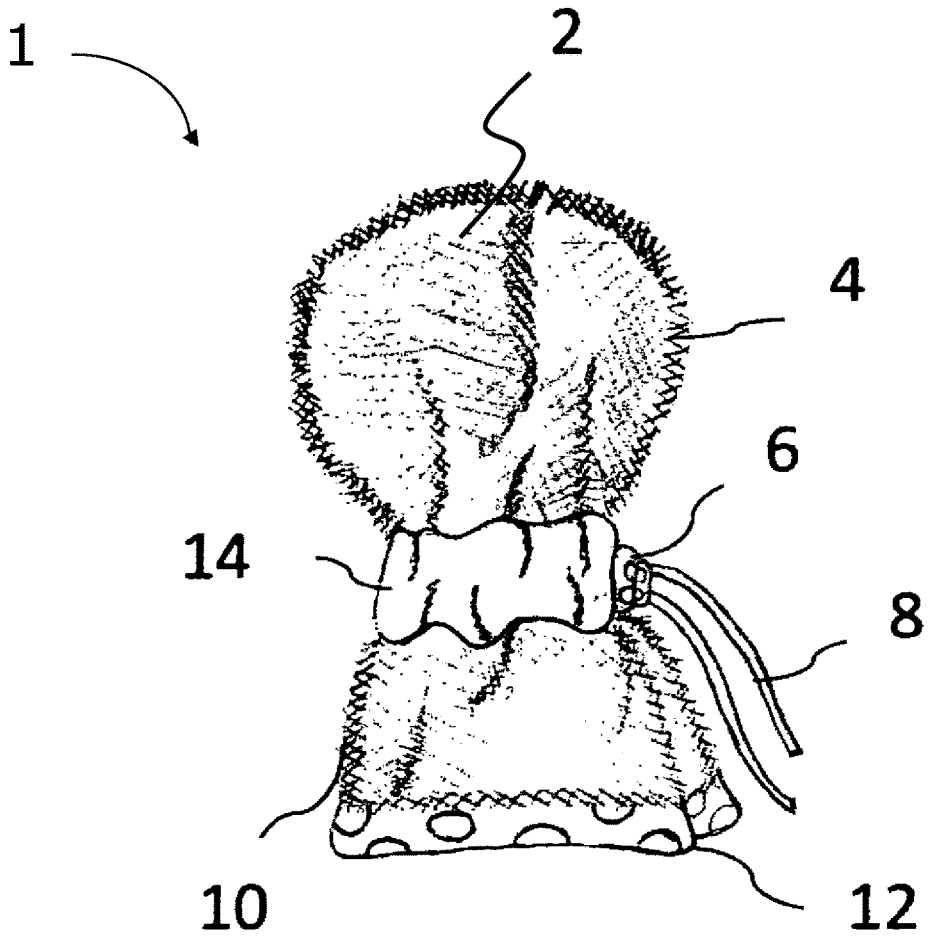
FIG. 1A illustrates a front view of a first embodiment of the present invention.
Figure 1B:
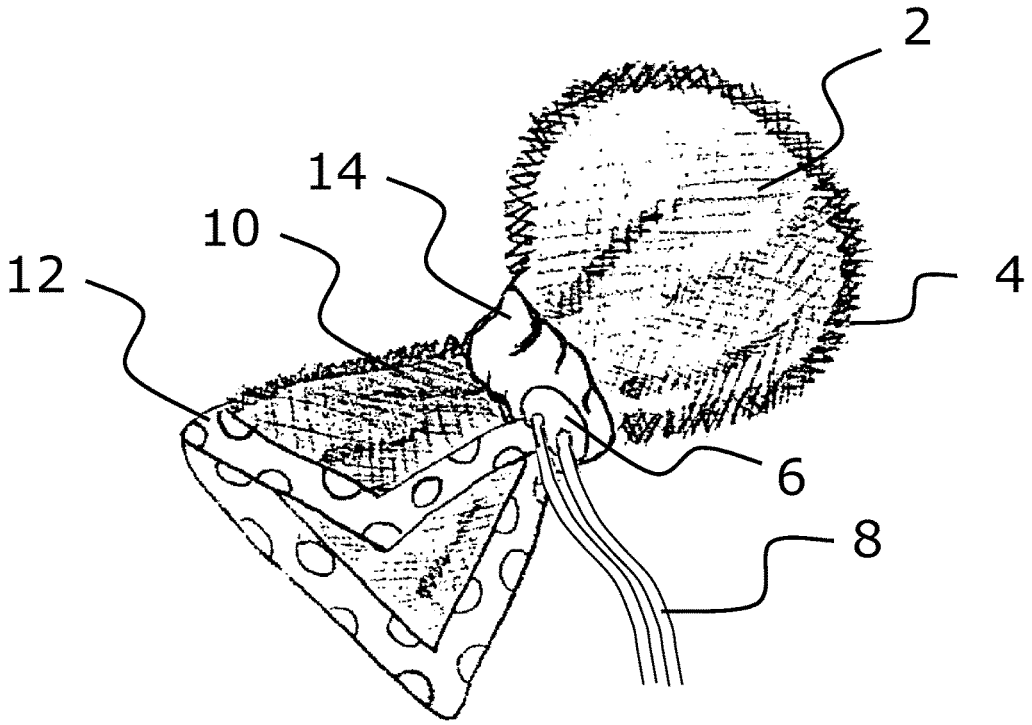
FIG. 1B illustrates a perspective view of a first embodiment of the present invention.
Figure 1C:
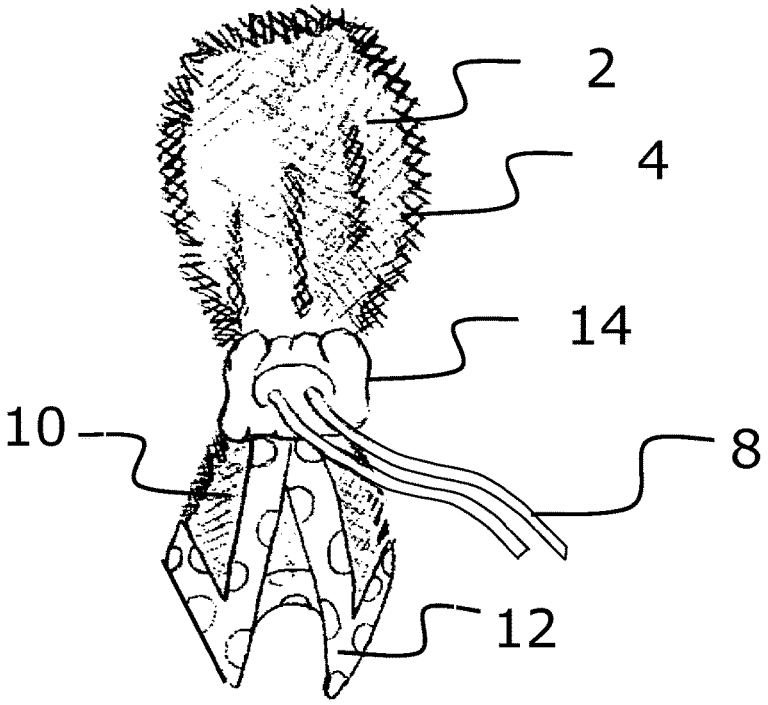
FIG. 1C illustrates a side view of a first embodiment of the present invention.
Figure 1D:
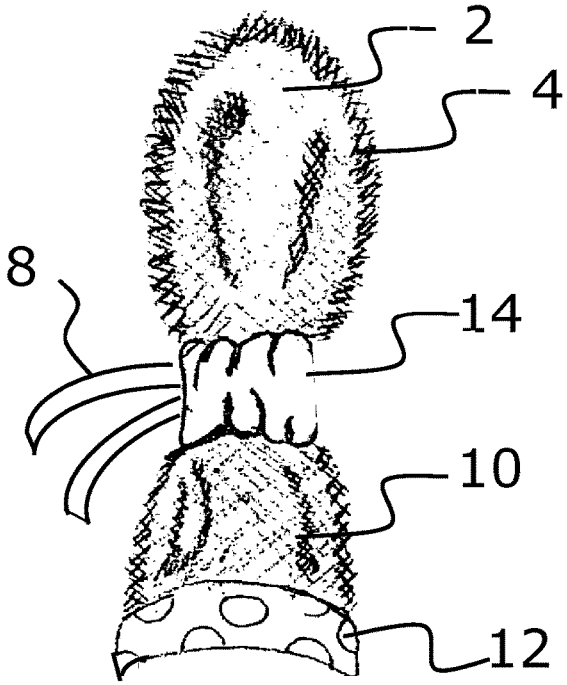
FIG. 1D illustrates a rear view of a first embodiment of the present invention.
Figure 2:
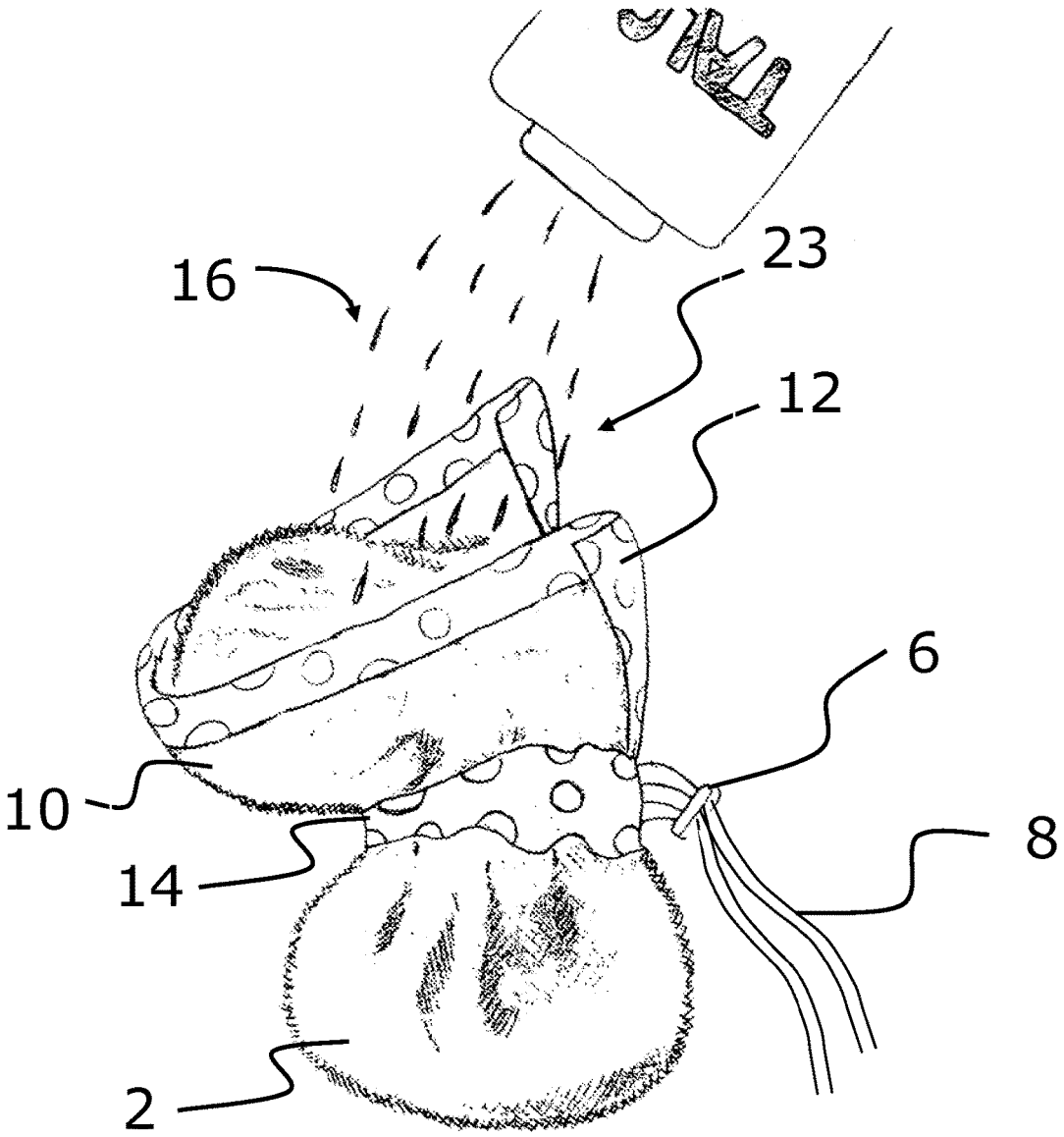
FIG. 2 illustrates a front perspective view of the device with powder being poured into the device.

The present grooming device, designated generally as 1, is used to groom a hair-styling patron by absorbing any sweat, moisture, or skin oil on the patron and applying a light layer of powder, thus enabling unwanted cut-away hair to be more easily brushed off the skin. The device 1 comprises a powder-dispensing head 2, which is attached to or integral with a holder 10. Holder 10 is also referred to as a hand curtain because when cinched curtain-like pleats or folds in the holder. The powder 16 is retained in the head 2 with the use of a retainer 14.

The head 2 holds a powdery substance, referred to generally as a powder 16 and described in more detail below, which is released in small amounts through the walls of the head 2 when the head 2 is gently tapped or shaken. Preferably the head 2 is generally round or disc-shaped so that no corners poke the patron nor trap powder. The head 2 is made of a flexible material such as woven or non-woven microfiber, linen, silk, wool, rayon, cotton, microcotton, polyester, polyethylene, polypropylene, paper, breathable dry weave material, or any other material enabling powder 16 to pass from inside the head 2 to outside the head 2 through the holes in the mesh or weave. Preferably the material is highly absorbent. The head 2 may further comprise head trim 4 to add structural rigidity to the head 2. Preferably the head trim 4 is disposed at the periphery of the head 2 and may partially or completely surround the head. Typically the head trim comprises a seam of layers of the head material connected together with stitches or adhesive, a separate piece of the same or different material attached to the head 2, or a stay attached to the head 2. The head trim 4 allows for the powder 16 retained in the head 2 to move freely. See FIGS. 1A-1D.

The holder 10 is the portion of the device 1 that is held by the stylist while using the device. The holder 10 is attached to or integral with the head 2. The holder 10 does not contain powder and gives the user a handle to apply the head 2 to the patron in a way that limits the amount of powder that gets on the user's hand. The holder 10 can be made of either woven or un-woven material such as microfiber, linen, silk, wool, rayon, cotton, microcotton, polyester, polyethylene, polypropylene, paper, or any other material. Preferably the holder 10 is a material such that it can be washed or dried at high temperatures. In a preferred embodiment the holder 10 is made of a material being highly absorbent. Preferably the holder 10 is comprised of the same material as that of the head 2 for ease of manufacturing. Another embodiment has the holder 10 made of a material different from that of the head 2. The holder 10 is preferably as flexible as the head 2 but may be more or less rigid.

A retainer 14 is disposed at the intersection of the head 2 and the holder 10. The retainer 14 cinches and relaxes the device 1 to create a cavity in the head 2 and secure it closed so that little or no powder 16 escapes through the head-holder opening when the device 1 is used. In this way the user's hand stays relatively powder-free because it is not holding the part with the powder in it. The retainer 14 is positioned on the device 1 such that it creates a head 2 sized to contain sufficient powder 16, a holder 10 sized to enable comfortable and secure grasping by the user, and a weight balance between the head 2 and the holder 14 to make the device easy and comfortable to use.

Figure 3A:
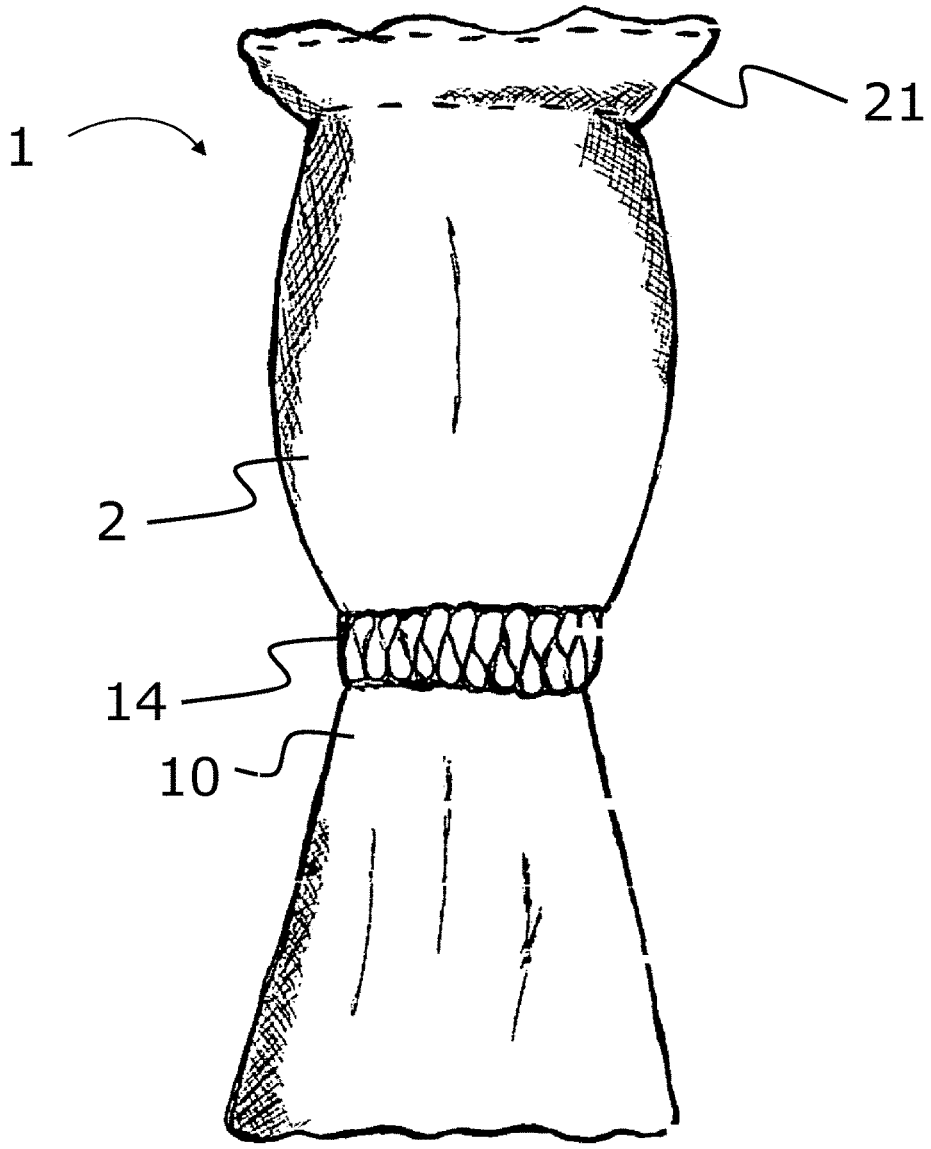
FIG. 3A illustrates a front view of a second embodiment of the present invention.
Figure 3B:
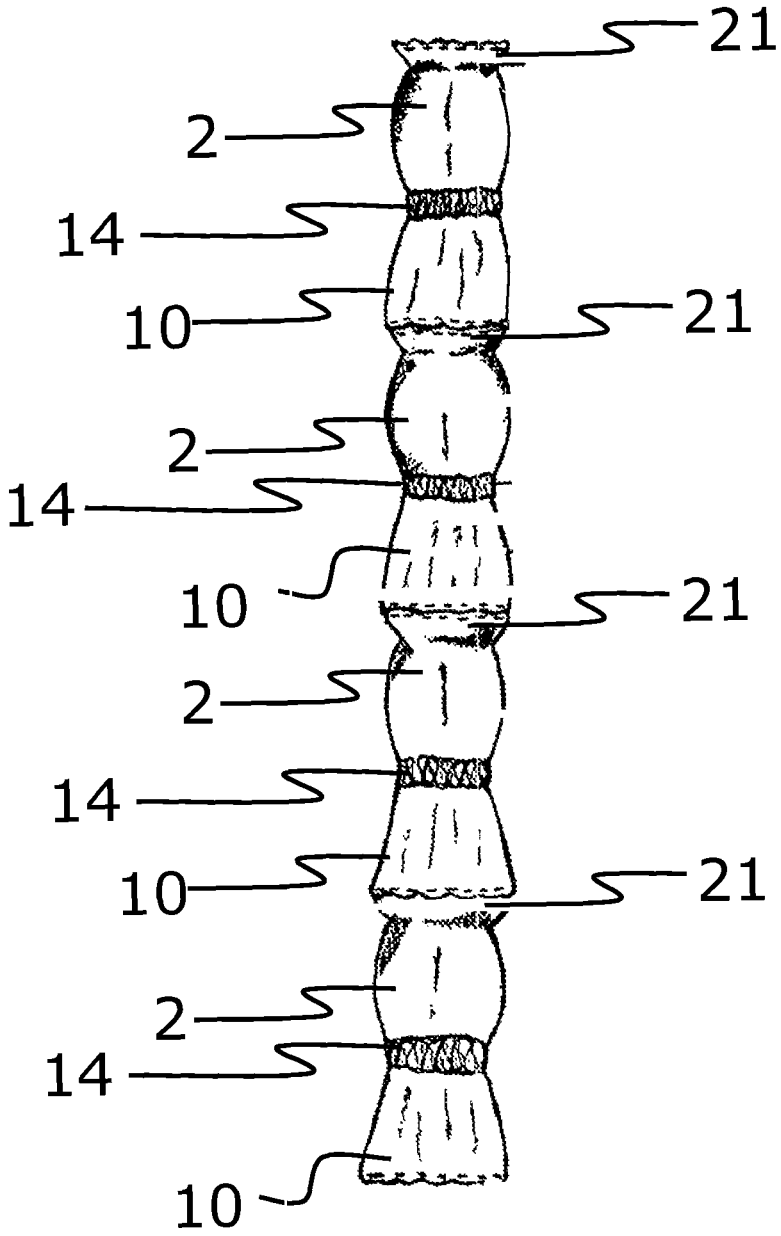
FIG. 3B illustrates a front view of multiple second embodiments of the present invention connected together in a sequence.
Figure 4A:
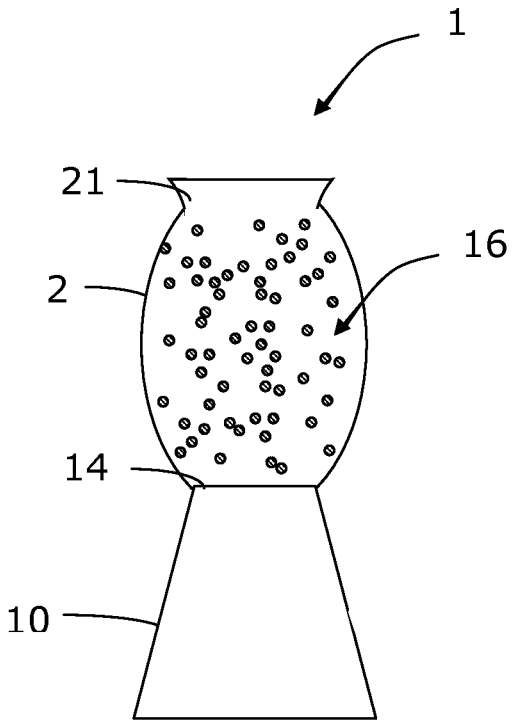
FIG. 4A illustrates the second embodiment of the invention with powder in it.
Figure 4B:
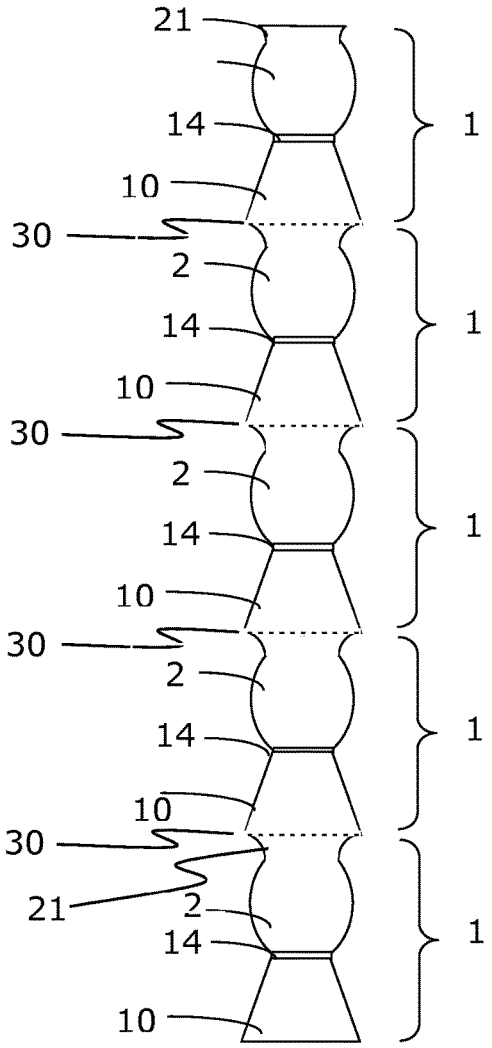
FIG. 4B illustrates a front view of multiple devices shown in FIG. 4A connected together in a sequence.
Figure 4C:
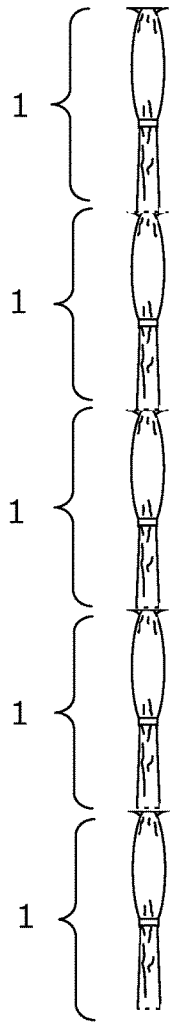
FIG. 4C illustrates a front view of multiple devices shown in FIG. 4A compressed and connected together in a sequence.

The retainer 14 may be any closing means including stitching, an elastic band, hook-and-loop band such as Velcro®, cord, ribbon, string, weld, or other mechanism that enables the head 2 to be cinched closed during use. The retainer 14 may close the opening independent of a fastener, but preferably the retainer 14 is secured closed using a fastener such as a spring lock 6, or in the case of a tie cord, a knot. See FIG. 2. FIGS. 1A-D and 2 show one embodiment of the retainer 14 as a tie cord 8 moveable within a sheath and secured with a spring lock fastener 6. FIGS. 3A-B show a second embodiment of the retainer 14 as an elastic band. FIGS. 4A-C show a third embodiment of the retainer 14 as a seam created by stitching or a weld created by pressing, heating, or adhesive.

In a preferred embodiment the powder 16 is talcum powder. Other powders 16 include arrowroot powder, corn flour, cornstarch, rice flour, or any other powdered substance that absorbs moisture or oil or both.

For a reusable device 1, the holder 10 comprises one or more openings 23 in communication with one or more openings in the head 2 such that powder 16 can be poured into the head cavity through the holder and the cavity refilled as needed. See FIG. 2. In a first embodiment the holder 10 has a side opening so that it can be folded down for easy access to the head. See FIGS. 1B, 1C and 2. Any free edge of the holder 10 may be protected with holder trim 12 to prevent the edges from fraying. The holder trim 12 may be a selvage edge, the same material as the head, or a different material. Preferably the holder trim 12 is comprised of a material that can be washed or dried at high temperatures so that it can be easily sanitized. Preferably the device 1 is made of terry cloth that can be laundered with the towels that are used on the patrons.

In another embodiment the device is disposable and therefore does not need to be refilled. Instead, the device 1 is made with powder 16 placed in the head 2 during manufacturing and each device 1 is thrown away after each use. FIGS. 4A-C and 5A-B illustrate the embodiment of a disposable device.

The head may further comprise a head ribbon 21 that is attached to or integral with at least a portion of the head 2, which detachably connects to a second grooming device at its holder 10 or holder trim 14. In this way multiple devices may be detachably connected end to end. See FIGS. 3B and 4B-4C. The head ribbon 21 aids in dispensing the device 1 from a dispenser 31. In a preferred embodiment a first device 1 is detachably connected to one or more second devices 1 by perforations to the head ribbon 21, holder 10 or holder trim 12. In this way a plurality of the devices 1 can be connected together in a chain, as shown in FIGS. 4B-C. A single device 1 can be disconnected from the chain at the head ribbon 21. In another embodiment the head ribbon 21 is folded back over the head so that the head 2 of a first device lays on the holder 10 of a second device in an overlapping accordion fashion to form a stack. In this way multiple separate devices are stacked on top of one another. A single device 1 can be separated from the stack, leaving the remaining devices 1 in an orderly stack.

Figure 5A:
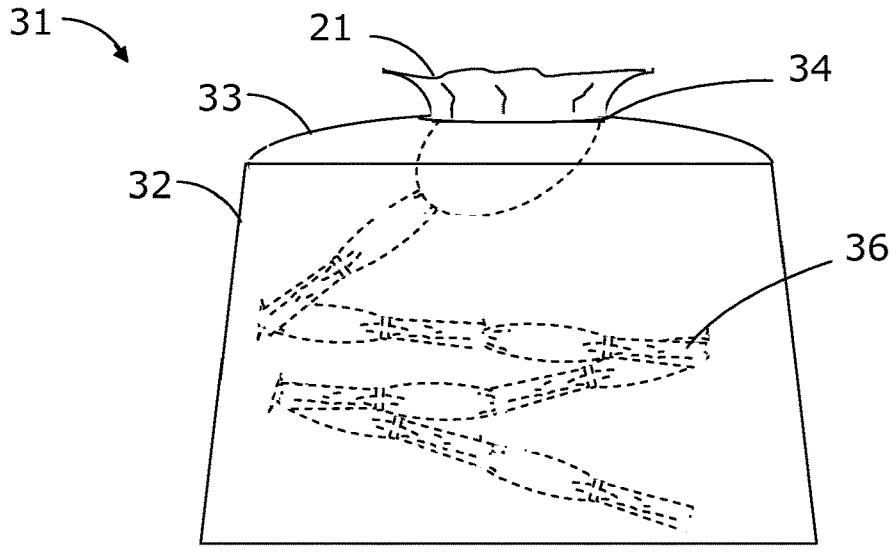
FIG. 5A illustrates a side view of a dispenser for separating the multiple second embodiments into single devices.
Figure 5B:
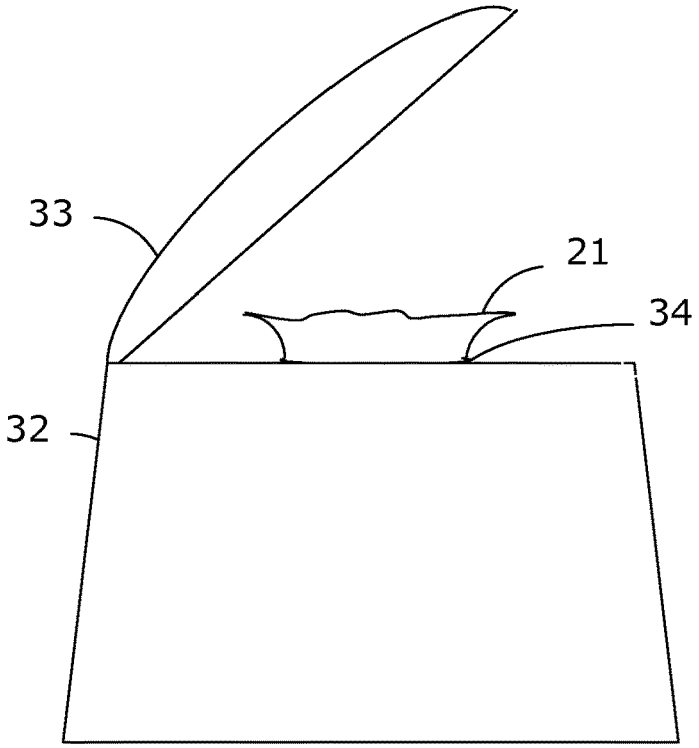
FIG. 5B illustrates a dispenser with a closeable lid.

FIGS. 5A-B show a dispenser 31 with the head ribbon 21 of a single device 1 extending out of an opening in the dispenser 31. The dispenser 31 comprises a body 32, a lid 33, and the dispenser opening 34. The dispenser opening 34 may be in the body 32, as shown in FIG. 5A, or in the lid 33, as shown in FIG. 5B. The lid is designed to contain the devices in a sanitary manner. Preferably the body 32 comprises an internal area large enough that a plurality 36 of the devices can be retained inside, as shown in FIG. 5A. The dispenser opening 34 is sized such that a device 1 can be pulled from the inside body 32 and through the dispenser opening 34. The single device 1 then is subsequently detached from the plurality 36 of devices remaining in the body 32. In one embodiment the plurality 36 of devices have perforations between the head ribbon 21 and the holder 10 or holder trim 14 and the dispenser opening 34 is rigid enough to cause a first device 1 to be separated from a second device 1 at the perforations when the first device is pulled against the edge of the dispenser opening 34. The dispenser 31 may be decorated with logos, coupons, designs, or other writings and images. The dispenser may be made of plastic, paper, metal or any material able to contain the devices in a sanitary manner.

A coupon may be placed at or near the bottom of the dispenser that can be seen when the last few devices 1 are removed from this dispenser. The coupon reminds the stylist that it's time to get more devices 1 and may offer a discount or other incentive to purchase more of a given brand.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

I claim:

1. A grooming device comprising:

a) a first powder-dispensing head having a first end and a second end, the first head made of a powder-permeable material that permits powder to pass from inside the first head to outside the first head through the holes throughout the first head;

b) a first head ribbon attached to or integral with the first end of the first head;

c) a first holder connected to the second end of the first head at an intersection, d) a first retainer positioned at the intersection of the first head and the first holder such that, when closed, creates a first cavity in the first head; and e) loose powder in the first cavity;

f) a second powder-dispensing head detachably connected to the first holder;

g) a second head ribbon attached to or integral with at least a portion of the second head;

h) a second holder connected to the second head;

i) a second retainer positioned at the intersection of the second head and the second holder such that, when closed, creates a second cavity in the second head; and j) loose powder in the second cavity, wherein the second head ribbon is detachably connected to the first holder with perforations.

* * * * *